US011378354B1

(12) United States Patent
Porat

(10) Patent No.: US 11,378,354 B1
(45) Date of Patent: Jul. 5, 2022

(54) FIREARM FOREGRIP

(71) Applicant: Recover Innovations Ltd., Holon (IL)

(72) Inventor: Tamir Porat, Tel Aviv (IL)

(73) Assignee: Recover Innovations Ltd., Tel Aviv (IL)

( * ) Notice: Subject to any disclaimer, the term of this patent is extended or adjusted under 35 U.S.C. 154(b) by 0 days.

(21) Appl. No.: 17/307,125

(22) Filed: May 4, 2021

(51) Int. Cl.
*F41C 23/16* (2006.01)

(52) U.S. Cl.
CPC ..... *F41C 23/16* (2013.01)

(58) Field of Classification Search
CPC ..... F41C 23/16; F41C 23/12
USPC ..... 42/71.01, 72
See application file for complete search history.

(56) References Cited

U.S. PATENT DOCUMENTS 7,121,034 B2 * 10/2006 Keng ..... F41A 23/10 42/72

* cited by examiner

*Primary Examiner* — Reginald S Tillman, Jr.
(74) *Attorney, Agent, or Firm* — Dekel Patent Ltd.; David Klein

(57) ABSTRACT

A firearm accessory includes a firearm foregrip including a grip portion that includes a first mounting rail interface at a first end of the firearm foregrip, and a second mounting rail interface at another portion of the firearm foregrip, the mounting rail interfaces being mountable on an accessory mounting rail of a firearm.

9 Claims, 1 Drawing Sheet

FIREARM FOREGRIP

FIELD OF THE INVENTION

The present invention relates to firearms in general and, in particular, to a foregrip for a firearm.

BACKGROUND OF THE INVENTION

Many firearms, particularly rifles, are controlled with a firing hand holding a portion of the firearm stock, and the non-firing or off-hand holding a foregrip or hand guard surrounding the firearm barrel. A conventional AR-15 rifle includes as original equipment a polymer hand guard encircling the barrel of the rifle. However, the large diameter can be cumbersome to grasp, and can lead to fatigue in the off-hand, particularly when many rounds are fired. To address this drawback, numerous styles of foregrips have been introduced to improve the shooter's comfort and accuracy. Pistol style grips and vertical foregrips are two such examples.

Although pistol and vertical foregrips can be useful and may be advantageous for certain applications, they too suffer from drawbacks. One noted problem is that they may be comfortable in one shooting position, such as standing, but do not rapidly adapt to other positions, such as a crouch or prone position. Sometimes the foregrip being vertical makes shooting cumbersome, depending on the shooting position.

SUMMARY OF THE INVENTION

The present invention seeks to provide a novel firearm foregrip, as is described hereinbelow.

There is thus provided in accordance with a non-limiting embodiment of the present invention a firearm accessory including a firearm foregrip including a grip portion that includes a first mounting rail interface at a first end of the firearm foregrip, and a second mounting rail interface at another portion of the firearm foregrip, the mounting rail interfaces being mountable on an accessory mounting rail of a firearm.

In accordance with a non-limiting embodiment of the present invention the second mounting rail interface is at an end opposite to the first end of the firearm foregrip.

In accordance with a non-limiting embodiment of the present invention the first and second mounting rail interfaces are tilted with respect to a longitudinal axis of the grip member at different angles.

In accordance with a non-limiting embodiment of the present invention the first mounting rail interface is perpendicular to the longitudinal axis and the second mounting rail interface is tilted with respect to the longitudinal axis at an acute angle or an obtuse angle.

In accordance with a non-limiting embodiment of the present invention the grip portion is formed with different textures.

In accordance with a non-limiting embodiment of the present invention the grip portion includes partial rings spaced from one another by gaps.

In accordance with a non-limiting embodiment of the present invention the partial rings are joined at a common longitudinal spine.

In accordance with a non-limiting embodiment of the present invention the partial rings include one set of partial rings with the spine facing in a shooting direction and another set of partial rings with the spine facing in another direction.

In accordance with a non-limiting embodiment of the present invention the firearm foregrip may be constructed of left and right halves secured together by fasteners.

BRIEF DESCRIPTION OF THE DRAWINGS

The present invention will be understood and appreciated more fully from the following detailed description taken in conjunction with the drawings in which.

DETAILED DESCRIPTION

Figure 1:
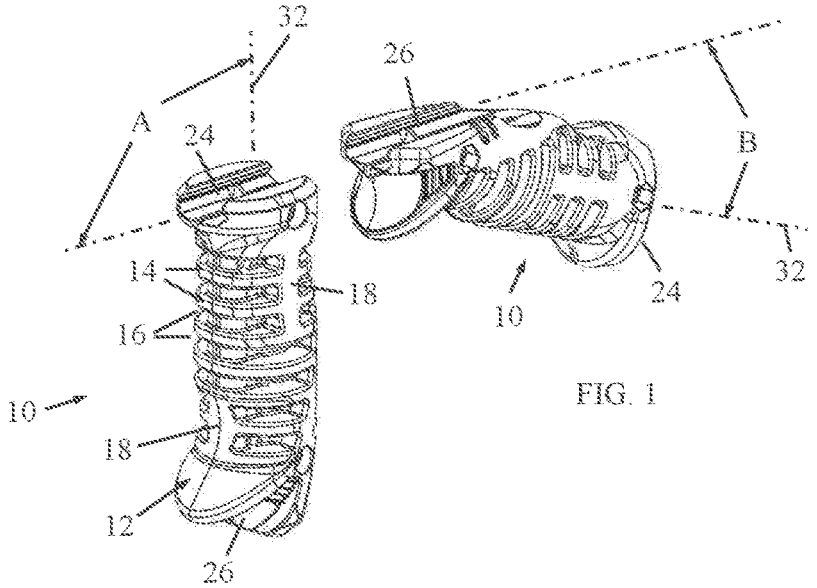
FIG. 1 is a simplified perspective illustration of a firearm foregrip, showing two different mounting provisions, in accordance with a non-limiting embodiment of the present invention.

Reference is now made to FIG. 1, which illustrates a firearm foregrip 10, in accordance with a non-limiting embodiment of the present invention.

The firearm foregrip 10 may include a grip portion 12, which may be formed with different textures for enhancing grip strength and comfort. In one non-limiting example, the grip portion 12 may include partial rings 14 spaced from one another by gaps 16. The partial rings 14 may be joined at a common longitudinal spine 18. As seen in FIG. 1, there may be one set (e.g., the lower set) of partial rings 14 with the spine 18 facing in the shooting direction (forward), whereas another set (e.g., the upper set) of partial rings 14 may have its spine 18 facing in another direction, such as being phase-shifted 90° with respect to the other spine (so that it faces to the side). Other angular phase shifts and other arrangements are in the scope of the invention.

The firearm foregrip 10 may be constructed of metal (e.g., steel or aluminum alloy) or a polymer, such as a glass-fiber reinforced polyamide, or ZYTEL from Dupont, or other materials such as wood.

Figure 2:
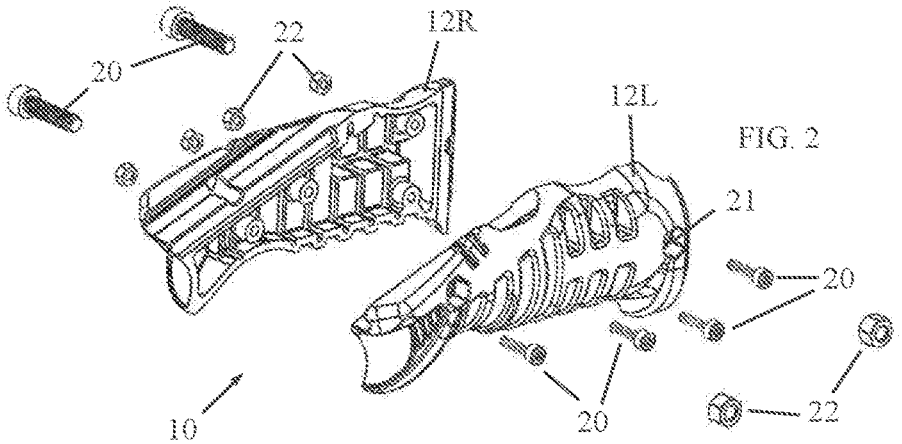
FIG. 2 is an exploded assembly illustration of the firearm foregrip.

As seen more in detail in FIG. 2, the firearm foregrip 10 may be constructed of left and right halves 12L and 12R, secured together by fasteners 20, such as bolts which pass through mounting holes 21 and which are tightened by nuts 22. As seen, fasteners of different sizes may be used and some of the fastener heads may be positioned on one of the halves and some of the fastener heads may be on the other of the halves.

Reference is made again to FIG. 1. In accordance with a non-limiting embodiment of the present invention, the firearm foregrip 10 may include a first mounting rail interface 24 at one end (e.g., the upper end) of firearm foregrip 10, and a second mounting rail interface 26 at another portion of firearm foregrip 10. In the preferred embodiment, the second mounting rail interface 26 is at the opposite end of firearm foregrip 10 (in this case, the lower end). The first and second mounting rail interfaces 24 and 26 interface with an accessory mounting rail 28 (FIG. 3) of a firearm 30, such as a Picatinny or Weaver mounting rail.

Figure 3:
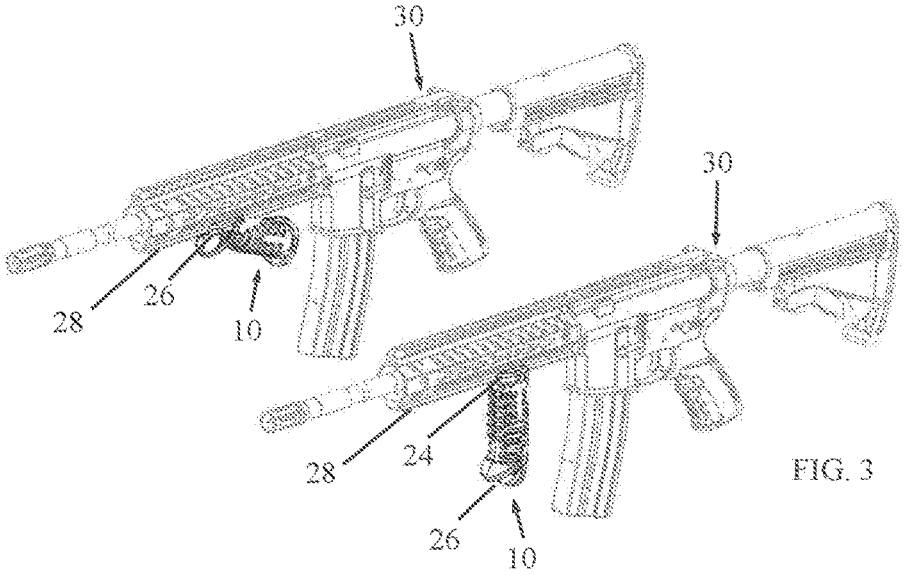
FIG. 3 is a simplified perspective illustration of the firearm foregrip mounted on the underside of an accessories rail (e.g., Picatinny rail) of a firearm (e.g., an assault rifle), in accordance with a non-limiting embodiment of the present invention.

As seen in FIG. 1, the mounting rail interfaces 24 and 26 of firearm foregrip 10 are tilted with respect to a longitudinal axis 32 of grip member 12 at different angles A and B, respectively. For example, A may be 90°, whereas B may be an acute angle or an obtuse angle. Accordingly, as seen in FIG. 3, firearm foregrip 10 may be mounted at two different angles with respect to the accessory mounting rail 28 of firearm 30.

What is claimed is:

1. A firearm accessory comprising:

a firearm foregrip comprising a grip portion that comprises a first mounting rail interface at a first end of said firearm foregrip, and a second mounting rail interface at another portion of said firearm foregrip, said mounting rail interfaces being mountable on an accessory mounting rail of a firearm.

2. The firearm accessory according to claim 1, wherein said second mounting rail interface is at an end opposite to the first end of said firearm foregrip.

3. The firearm accessory according to claim 1, wherein said first and second mounting rail interfaces are tilted with respect to a longitudinal axis of said grip member at different angles.

4. The firearm accessory according to claim 3, wherein said first mounting rail interface is perpendicular to said longitudinal axis and said second mounting rail interface is tilted with respect to said longitudinal axis at an acute angle or an obtuse angle.

5. The firearm accessory according to claim 1, wherein said grip portion is formed with different textures.

6. The firearm accessory according to claim 1, wherein said grip portion comprises partial rings spaced from one another by gaps.

7. The firearm accessory according to claim 6, wherein said partial rings are joined at a common longitudinal spine.

8. The firearm accessory according to claim 6, wherein said partial rings comprise one set of partial rings with said spine facing in a shooting direction and another set of partial rings with said spine facing in another direction.

9. The firearm accessory according to claim 1, wherein said firearm foregrip is constructed of left and right halves secured together by fasteners.

* * * * *